US010765169B2

(12) United States Patent
Bramani

(10) Patent No.: US 10,765,169 B2
(45) Date of Patent: Sep. 8, 2020

(54) HIGH FOOT MOBILITY SHOE

(75) Inventor: Marco Bramani, Albizzate (IT)

(73) Assignee: VIBRAM S.P.A., Albizzate (VA) (IT)

( * ) Notice: Subject to any disclaimer, the term of this patent is extended or adjusted under 35 U.S.C. 154(b) by 61 days.

(21) Appl. No.: 13/148,682

(22) PCT Filed: May 4, 2010

(86) PCT No.: PCT/IB2010/051953

§ 371 (c)(1),
(2), (4) Date: May 30, 2013

(87) PCT Pub. No.: WO2011/138638

PCT Pub. Date: Nov. 10, 2011

(65) Prior Publication Data

US 2013/0232820 A1 Sep. 12, 2013

(51) Int. Cl.

| | |
|---|---|
| ***A43B 7/26*** | (2006.01) |
| ***A43B 13/14*** | (2006.01) |
| ***A43B 13/26*** | (2006.01) |
| ***A41B 11/00*** | (2006.01) |

(52) U.S. Cl.

CPC ..... *A43B 7/26* (2013.01); *A41B 11/004* (2013.01); *A41B 11/008* (2013.01); *A43B 13/141* (2013.01); *A43B 13/26* (2013.01)

(58) Field of Classification Search

CPC ..... A43B 7/26; A43B 11/004; A43B 11/02; A43B 11/008; A43B 13/22; A43B 13/223

USPC ..... 36/94, 59 A, 59 C

See application file for complete search history.

(56) References Cited

U.S. PATENT DOCUMENTS

| | | | | |
|---|---|---|---|---|
| 3,967,390 | A * | 7/1976 | Anfruns | 36/94 |
| 4,494,320 | A * | 1/1985 | Davis | A43B 13/223 36/103 |
| 4,651,354 | A | 3/1987 | Petrey | |
| 5,774,898 | A * | 7/1998 | Malpee | 2/239 |
| 7,101,604 | B1 * | 9/2006 | Minges | A43B 3/0078 36/28 |
| D552,333 | S * | 10/2007 | McClaskie | A43B 13/223 D2/953 |
| 7,346,935 | B1 * | 3/2008 | Patterson | 2/239 |
| D575,040 | S | 8/2008 | Bramani | |
| D626,311 | S * | 11/2010 | Zhang | A43B 7/26 D2/898 |
| D639,535 | S * | 6/2011 | Eggert | A43B 7/26 D2/898 |

(Continued)

FOREIGN PATENT DOCUMENTS

| | | |
|---|---|---|
| GB | 2249939 | 5/1992 |
| WO | 9817138 A1 | 4/1998 |

(Continued)

OTHER PUBLICATIONS

International Search Report PCT/IB2010/051953; dated Feb. 24, 2011.

(Continued)

*Primary Examiner* — Katharine Gracz

(74) *Attorney, Agent, or Firm* — Cantor Colburn LLP

(57) ABSTRACT

High foot mobility footwear, including a sole and an upper that define separated front seats to hold respectively toes or groups of toes, where the sole includes a plurality of portions resting on the ground, substantially contiguous to each other along the plantar surface.

17 Claims, 3 Drawing Sheets

(56) References Cited

U.S. PATENT DOCUMENTS

| | | | | |
|---|---|---|---|---|
| D661,074 | S * | 6/2012 | Bramani | D2/951 |
| 2005/0166427 | A1 | 8/2005 | Greene | |
| 2006/0165269 | A1 | 7/2006 | Lin | |
| 2007/0144039 | A1 * | 6/2007 | Fliri | 36/94 |
| 2008/0263893 | A1 * | 10/2008 | Hernandez | 36/1 |

FOREIGN PATENT DOCUMENTS

| | | | |
|---|---|---|---|
| WO | 2005037004 | A1 | 4/2005 |
| WO | 2007038487 | A2 | 4/2007 |

OTHER PUBLICATIONS

International Search Report PCT/IB2010/051954; dated Feb. 28, 2011.

* cited by examiner

HIGH FOOT MOBILITY SHOE

TECHNICAL FIELD OF INVENTION

This invention refers to a shoe with high mobility for the foot, particularly but not exclusively for running and fitness.

BACKGROUND

Certain types of footwear are known and commercially available that reproduce the natural shape of the foot, in order to ensure better articular mobility especially of the toes and to give more comfort during the action of walking, giving the user the sensation of walking on bare feet while ensuring the necessary protection.

Such a type of footwear is described in the international patent application WO2007/038487 of the same applicant. This patent application describes a shoe in which the front part defines multiple portions independent of each other made of flexible material to accommodate the toes; such portions involve both the upper and the sole of the shoe.

These shoes have a non-slip sole which, although being made with a thin enough thickness and elastic material like rubber and similar, may not allow for a desired yielding during the execution of foot movements. The shoe, therefore, is extremely soft and yielding in the upper part, namely in the portion that covers the dorsum of the foot, while being stiffer at the sole, as the sole itself must ensure, however, a cushioning and protective effect of the plantar surface of the foot, that is, the surface of the foot that supports the weight of the user.

Furthermore, the sole of the above-mentioned known footwear does not guarantee, in particularly hard use conditions, as in the execution of extreme sports or similar, a sufficient non-slip grip on more difficult surfaces, such as those that are very slippery or inclined.

BRIEF SUMMARY OF THE INVENTION

The invention develops a shoe providing high mobility for the foot characterized by a high yielding and softness at the dorsum of the foot and at the foot sole.

The invention further provides a shoe with high mobility for the foot that allows for increased comfort, safety and user protection during walking, running or during other movements, particularly those performed in particularly difficult environmental conditions.

A key advantage achieved by the shoe according to an exemplary embodiment of the invention is that it provides increased comfort conditions during contact with the ground and in the execution of movements in each region of the foot, with regard to the yielding of the upper and the sole.

Another advantage achieved by the shoe according to an exemplary embodiment of the invention is that it allows to obtain, in during contact with the ground, the best adhesion and friction conditions, with no danger of sudden slipping or loss of contact, together with a high mobility of the foot and its toes. These conditions are guaranteed also in unfavorable situations such as those of wet and/or slippery and/or inclined surfaces.

BRIEF DESCRIPTION OF THE DRAWINGS

These and further advantages will be better understood by every skilled person from the following technical description and the attached drawings, given as a non-limitative example, in which.

DETAILED DESCRIPTION

Figure 1:
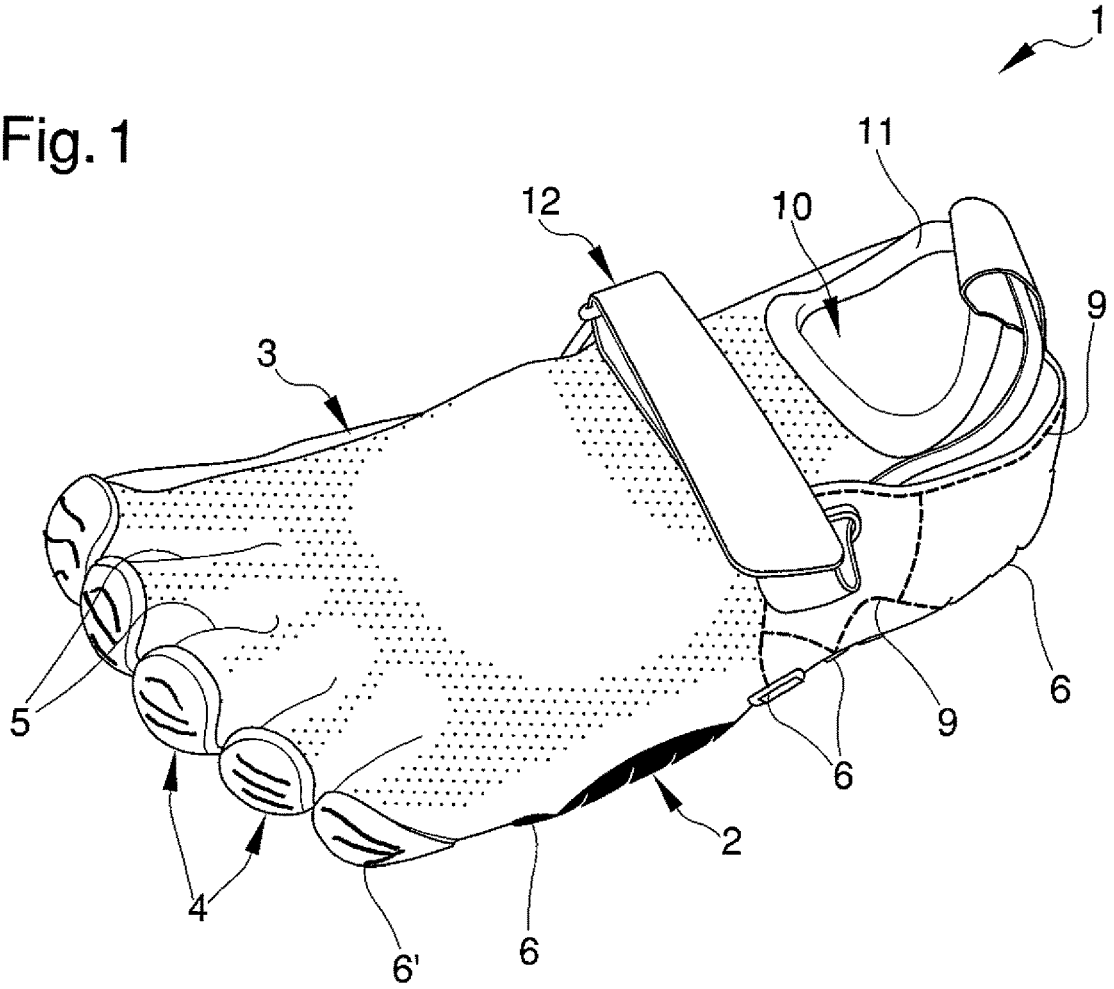
FIG. 1 is a perspective view of the shoe according to the present invention.

With reference to FIG. 1, a shoe with a high mobility for the foot according to the invention is indicated as a whole with 1.

In the embodiments that follow individual characteristics, given in relation to specific embodiments, may actually be interchanged with other different characteristics existing in other embodiments.

The shoe according to the invention is of general use, particularly but not exclusively indicated, thanks to its characteristics, for sports, recreation activities and the like.

The shoe 1 comprises a sole, overall indicated with 2, and an upper overall indicated with 3, mutually attached each other so as to cover completely or almost completely the surface of the foot.

Figure 3:
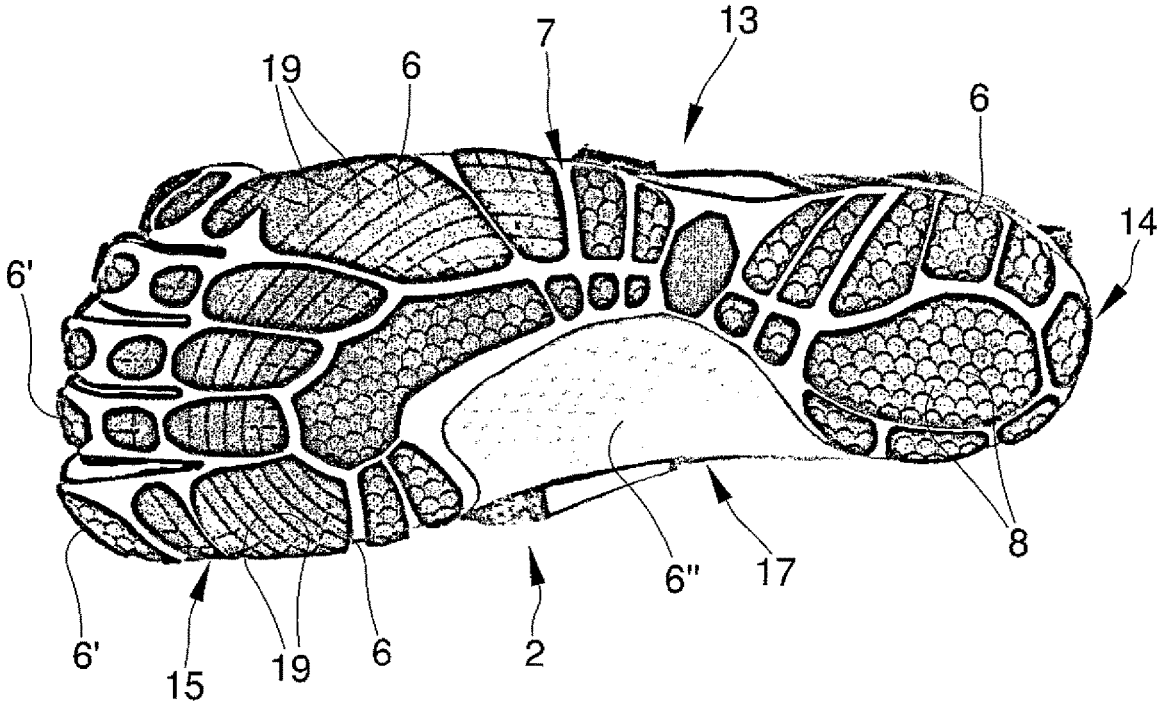
FIG. 3 is a bottom view of another embodiment of the shoe according to the present invention.

The sole 2 and upper 3, as visible in FIG. 3, define front seats 4 mutually separated each other by slots 5 for containing respective toes or groups of foot toes. More specifically, five front seats 4 are provided separated each other by slots 5 for containing the five respective toes of the foot.

Advantageously, the sole 2 of the shoe according to the present invention comprises a plurality of portions resting on the ground 6, 6', 6" substantially contiguous to each other along the plantar surface 7 and having respective surface bulges 8, thus achieving the important technical advantages that will be clarified later in the description.

The upper 3 of the shoe 1 is made of yielding material, such as the type of natural or synthetic leather, or even in another suitable type of natural or synthetic material to be employed in the field of footwear and having characteristics substantially equivalent.

The upper 3 could be produced in one single part or in more separate parts connected together, for example by sewn edges 9, visible in FIG. 1. Furthermore, the upper 3 has an opening 10 for foot insertion, corresponding to which there is an edge 11 of substantially traditional type.

As it is evident in FIG. 1, the upper 3 extends from the area of the dorsum of the foot to the area of the sole of the foot, as to completely or almost completely embrace the latter.

Inside the shoe 1 a foot's sole supporting insole could be provided, attached to the upper 3 and to the sole 2; the above-mentioned insole is not shown in the figures but is of a mainly known and traditional type.

The upper 3 comprises fastening means around the foot, indicated with reference number 12 in FIG. 1. Such fastening means 12 may be made by a buckle or other equivalent means.

Figure 2:
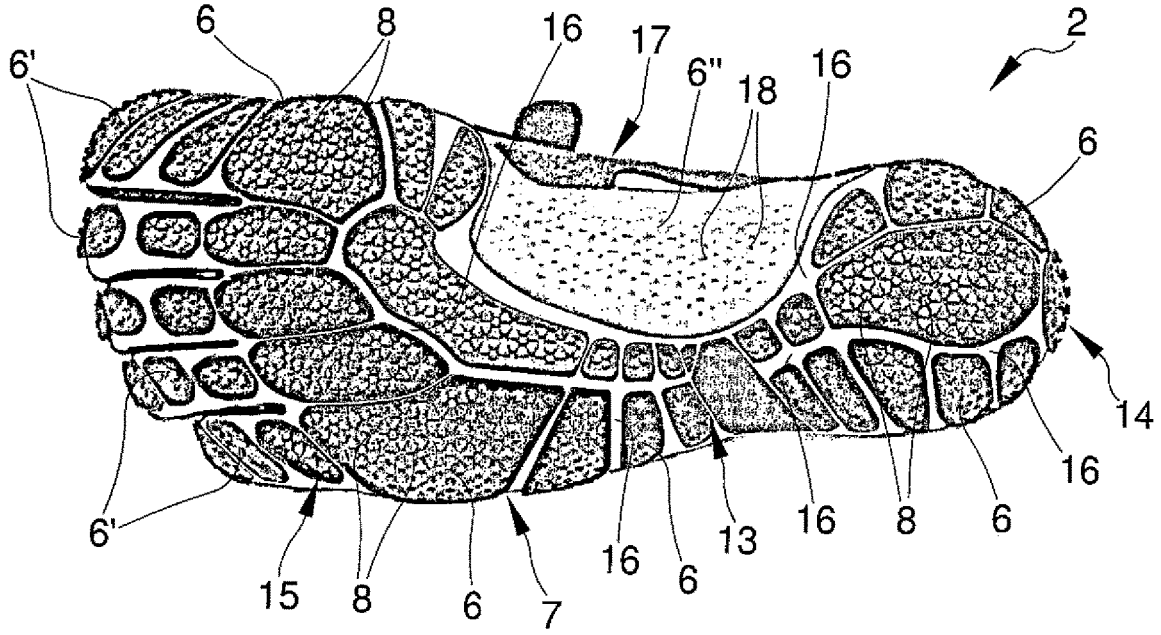
FIG. 2 is a bottom view of the shoe.

As shown in FIG. 2, the portions resting on the ground 6 that constitute the sole 2 have variable size and shape depending to the area of the plantar surface 7 in which they are located, and in particular depending to the possibilities of movement that such particular area have to possess. Therefore, for example, the resting portions 6 located the area of the isthmus 13 of the plantar surface 7 are smaller than those located, respectively, in the area of the heel 14 or of the forefoot 15.

Among the portions resting on the ground 6, furthermore, separation channels 16 are provided, which ensure that those above-mentioned portions 6 can freely move in space one in respect to another in relation to movements made by the user's foot.

These above-mentioned separation channels 16 are oriented differently in relation to, again, to areas of the plantar surface 7 where the resting portions 6 are located. For example, the separation channels 16 provided in the area of the isthmus 13 of the plantar surface 7 are oriented primarily in a substantially transverse direction, while the channels 16 located in the forefoot area 15 are oriented primarily in a substantially longitudinal direction.

Also the wideness of the above-mentioned separation channels 16 varies in relation to the respective position in the plantar surface 7. In fact, for example, the separation channels 16 that are located in the area corresponding to the forefoot 15 have smaller wideness than those located in the area corresponding to the isthmus 13, and this mainly due to the fact that the area of the isthmus 13 is normally less loaded than the forefoot 15 and/or the heel 14 area, and therefore it is possible to provide a smaller support surface, but with greater yielding and overall mobility of the shoe.

In one embodiment of the footwear according to the present invention, the portions resting on the ground 6 are attached to the upper 3 of the shoe by gluing; in another embodiment, portions resting on the ground 6 are attached to the upper 3 by stitching. In other embodiments of the shoe, the permanent connection of the portions 6 to the upper 3 can be obtained by other equivalent means of attachment, of a mainly known type. As mentioned, each of the portions resting on the ground 6 comprises a plurality of surface bulges 8 densely distributed one near the other, basically like a mosaic.

In the embodiment of the shoe illustrated in FIGS. 1 and 2, the surface bulges 8 have a substantially polygonal shape, for example triangular, square, pentagonal, or yet others, located in a way to fit one with the other in their distribution, in fact, as a mosaic.

The presence of the surface bulges 8 densely distributed on each of the portions 6 assures an optimal grip of the sole 2 of the shoe to the ground without risks of accidental slipping, also in particularly difficult use conditions, such as on very smooth and/or inclined surfaces.

The portions resting on the ground 6 are made of material of the type of polyurethane, that gives to the sole 2 a particular lightness, strength and elastic yielding so that the portions 6 act as shock absorbers; furthermore, they strengthen the fabric in the toe area, to resist tearing and material failure.

Moreover, the portions resting on the ground 6 are coated with at least a layer of breathable material which allows the outward diffusion of moisture that accumulates inside the shoe.

Said plurality of resting portions 6, which form the sole 2 of the shoe according to the present invention comprises phalangeal portions 6' provided at the five separated seats 4 of the shoe, which protect the contact with the ground of the foot toes, and that extend also above the seats 4 themselves, to give front protection. In particular, as shown in FIG. 2, for each of the five seats 4 three phalangeal portions 6' are provided, interspersed with separation channels 16 rather wide, to ensure greater freedom of movement to the toes themselves.

The plurality of resting portions 6 also comprises a medial portion 6", located along the plantar arch 17 of the sole of the foot, made of elastically flexible plastic material. Such medial portion 6" is therefore located in an area of the plantar surface 7 poorly or not at all loaded, and therefore has to accomplish the damping function lesser than the remaining resting portions 6, 6'. Therefore, the above-mentioned medial portion 6" is made of material of the type of ethylene vinyl acetate, also known by the acronym EVA, which is yielding and resistant, but at the same time very light, and therefore practically not felt by the user wearing the shoe. To allow, however, a sufficient friction also to the above-mentioned medial portion 6" on support surfaces such as rounded or acuminate rocks or similar, the medial portion 6" itself is provided with small notches 18 of polygonal shape, for example. With the solution according to the invention the user has clearly further important technical advantages.

A first technical advantage is that the shoe according to the invention, properly worn and fastened to the foot through the fastening means 12, allows the user to walk, run and make other movements in the foothold with maximum motion freedom, in relationship with all areas of the plantar surface 7: this allows to facilitate and increase tactile and prehensile activities of the sole of the foot, giving the user the feeling of walking barefoot with the maximum comfort and safety. Furthermore, sprint power in running is increased.

Moreover, the presence of bulges 8 on the portions resting on the ground 6, 6', 6" provides optimal grip of the sole 2 itself to all surfaces, even wet ones and/or slippery and/or inclined; in addition, the separation channels 16 allow to flow away the possibly amount of water or other fluid that is between the sole 2 and the ground, preventing the sliding of the user.

An additional benefit given by the shoe according to the present invention is that the bulges 8 of the portions resting on the ground 6, 6', 6" deform elastically under the weight of the user, and provide a foot impact cushioning on the ground during walk and/or run, as small pads: in this way the user comfort in his movements is increased compared with substantially smooth soles.

A further advantage pursued by the shoe according to the invention is that it encourages a forefoot strike, vs. a heel strike which is typical in traditional running shoes or athletic footwear with thick and/or rigid soles. It is believed that the forefoot strike is a more natural, healthier, and more efficient way to run. It creates less impact on the joints of the ankle, knee and hip.

The forefoot strike is also encouraged by the fact that the sole 2 of the shoe according to the present invention is flat, with no heel lift.

As can be seen in the attached drawings, the portions resting on the ground 6' are placed under the metatarsal head at the base of each toe. These portions are strategically placed to offer more plating protection and traction, but allow the foot maximum flexibility, ground feedback, and a natural range of movement.

The sole 2 must be thin enough to environmental feedback and natural movement, but with some thickness to offer protection, and a tread design to offer traction over various surfaces. The insole of the shoe can be made in thin polyurethane, which resists compression and works well with the sole 2 according to the invention.

Another embodiment of the shoe according to the invention is shown in FIG. 3. In the following description, parts corresponding to those of FIGS. 1, 2 are marked by the same reference numbers and will not be further described.

In this embodiment, the bulges 8 of some portions resting on the ground 6, 6', 6", particularly in the area of the isthmus 13 and heel 14, have a section substantially circular and greater than those of the previous embodiment. This determines lower yielding than the resting portions 6, 6', 6" with bulges of this shape, which is therefore more suitable for purely sport uses.

In the present embodiment other resting portions 6, 6', 6", especially those located in the forefoot 15, are provided with grooves 19 that extend substantially throughout all the transverse dimension of each of the portions 6, 6', 6" themselves. These grooves 19 allow to increase, in particular, the traction ability of the shoe during walking or running.

Figure 4:
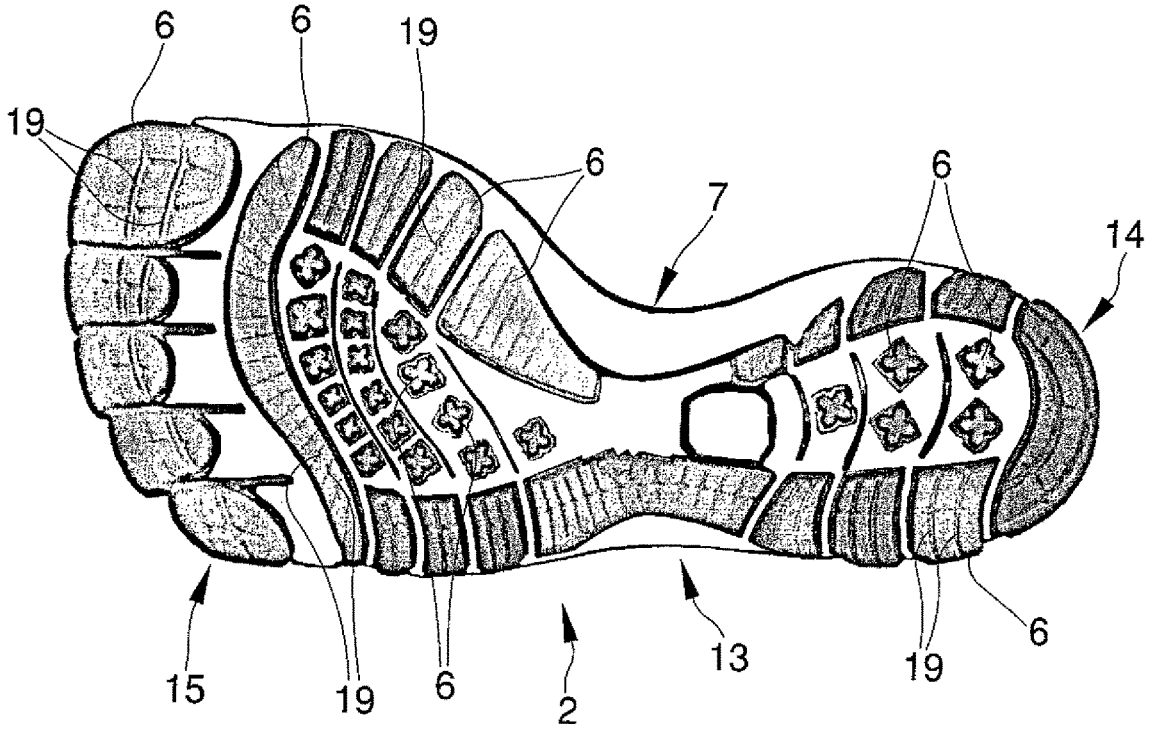
FIG. 4 is a bottom view of yet another embodiment of the shoe.

Another embodiment of the shoe according to the present invention is shown in FIG. 4. In the following description, parts corresponding to those of FIGS. 1, 2, 3 are marked by the same reference numbers and will not be further described.

In this embodiment, the portions resting on the ground 6, 6' have geometries and sizes differentiated in relation to areas of the plantar surface 7 in which they are provided; moreover, there is not the medial portion 6". The phalangeal portions 6' are in the number for just one for each seat 4.

The resting portions 6, located in the central plantar surface 7, namely in particular in the center of the heel 14 and the center of the forefoot 15, are substantially cross shaped and are arranged in about transverse rows; moreover, they have a significantly small size than the portions 6, 6' located in other parts of the plantar surface 7.

The remaining resting portions 6, 6' are, instead, affected by substantially transverse grooves 19, designed to increase the traction ability during walking or running.

Figure 5:
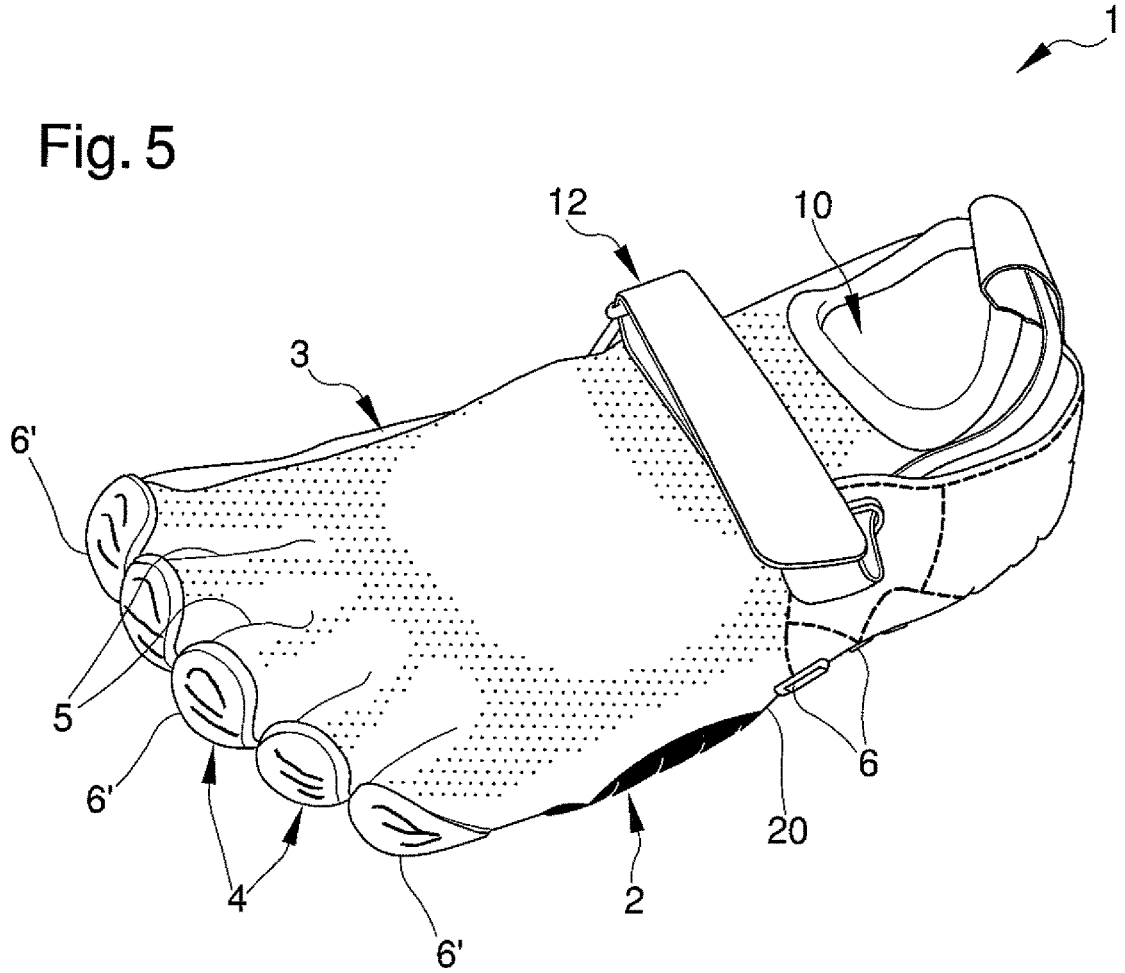
FIG. 5 is a perspective view of an alternative embodiment of the shoe.

The result of this configuration and arrangement of the resting support 6, 6' is a traction ability of the shoe significantly increased compared to previous embodiments, even in the heel area 14, and a reduced yielding and reduced mobility, especially in the area of seats 4 for the toes. This result sets, for the shoe according to the present embodiment, a specific use for walking and running than for other activities that require high mobility of each region of the foot. Yet another embodiment of the shoe according to the present invention is shown in the perspective view of FIG. 5.

In this embodiment the sole 2 of the shoe comprises a layer 20, substantially smooth and yielding, on which is distributed the plurality of portions resting on the ground 6, 6', 6": the layer 20, therefore, extends substantially throughout all the surface of the sole of the foot.

The layer 20 is attached below the upper 3, for example by gluing, by stitching or other equivalent means of permanent link.

The layer 20 is made of material of the type of rubber or other material with equivalent characteristics. The layer 20 is made with a thin thickness, for ensure high yielding to the shoe in every region of the foot. The portions resting on the ground 6, 6', 6", which could have any geometry and size—for example of the type described in any of the previous embodiments—are attached to layer 20 by known connection means, for example gluing, and are located therefore in relief compared to the latter. Or, they may be made integral to the layer 20 itself for co-molding, or by other known technologies that are not however an object of the present invention.

This embodiment of the shoe according to the invention shows, compared to those previously described, an overall yielding slightly lower, as the layer 20, also if is thin and in elastic material, limits the possibilities of foot movement; at the same time, however, the presence of the layer 20 increases the overall protection ability of the sole of the foot, particularly if used on particularly hard and rough surfaces.

Figure 6:
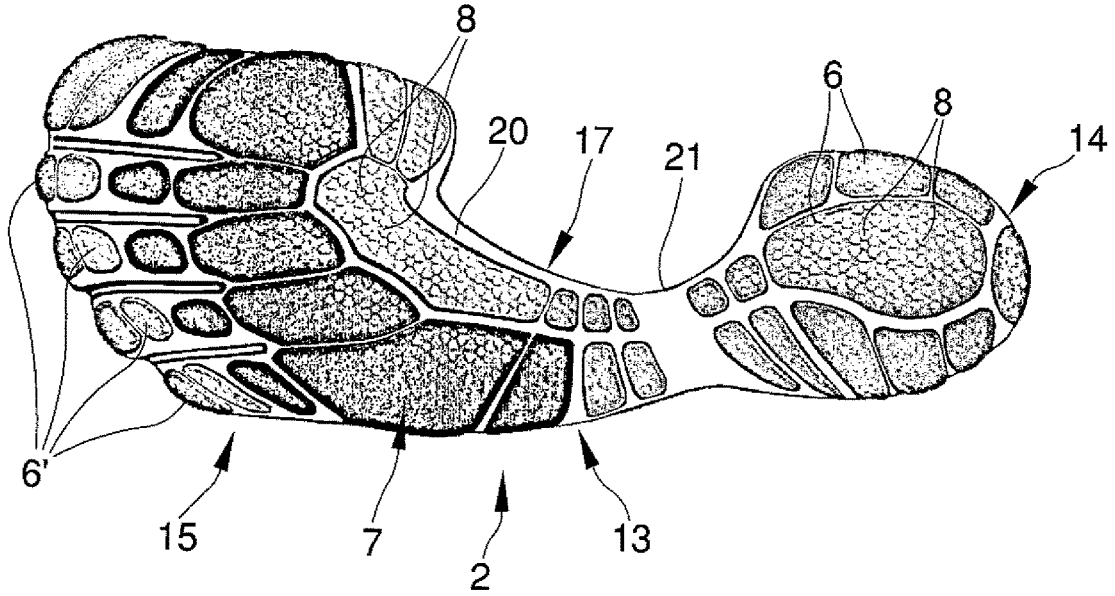
FIG. 6 is a bottom view of a further embodiment of the shoe according to the present invention.

Another embodiment of the shoe according to the present invention is shown in FIG. 6. In particular, in FIG. 6 the sole 2 of the shoe according to the present embodiment is shown. The sole 2 comprises a layer 20 defining a recess 21 at the plantar arch 17. On the layer 20 are attached portions resting on the ground 6, 6', of any geometry and size in relation to the specific application of the shoe.

The shoe comprising the sole 2 shown in FIG. 6 is therefore suitable to ensure optimal foot protection and excellent mobility of the same, because the medial portion 6" is not present. Moreover, always for the absence of the medial portion 6", the shoe has a total weight smaller than the previous embodiment. Thus it has been explained how the invention achieves the proposed objects.

The present invention has been described according to preferred embodiments, but equivalent variants can be developed without going beyond the scope of protection offered by the claims that follow.

The invention claimed is:

1. High foot mobility shoe, comprising an upper;

a sole disposed at a bottom of the upper separate front seats defined by the sole and upper and adapted to hold respective toes or toe groups of a wearer, a plurality of ground contacting portions disposed on the sole and configured to rest on the ground, the ground contacting portions being substantially contiguous to each other along a plantar surface, adapted to increase a prehensility of a foot of the wearer, separation channels delimited by said ground contacting portions and extending between adjacent ones of said ground contacting portions, the channels configured to ensure that said ground contacting portions can freely move in space one in respect to another in relation to movements made by a wearer's foot; and a plurality of surface bulges disposed on and protruding outwardly from at least one of the plurality of ground contacting portions, one surface bulge adjacent to another;

wherein said surface bulges have a substantially polygonal shape of a triangle, square or pentagon;

wherein said upper is adapted to extends both over a dorsum of a foot of the wearer and beneath a sole of the foot such that the upper is adapted to entirely surround the foot;

wherein the sole is affixed to the upper at an area where the upper is adapted to extend beneath the sole of the foot;

wherein said sole comprises a layer substantially smooth and yielding that extends continuously an entire length of the plantar surface from a heel area of the shoe to a toe area of the shoe and wherein said plurality of ground contacting portions are disposed on and extending from said layer; and wherein a first plurality of said ground contacting portions is disposed laterally across the sole in a forefoot area;

wherein a second plurality of said ground contacting portions is disposed laterally across the sole in an isthmus area;

wherein a third plurality of said ground contacting portions is disposed laterally across the sole in a heel area; and wherein the separation channels delimited by the respective first, second, and third pluralities of said ground contacting portions extend longitudinally, generally transverse to the lateral arrangement of said ground contacting portions;

wherein the separate front seats comprise five separate front seats and wherein each of said five separate front seats comprises three ground contacting portions delimiting the separation channels therebetween.

2. Shoe according to claim 1, wherein said surface bulges are disposed only on the ground contacting portions which are located in the isthmus and the heel areas of the sole and wherein the ground contacting portions located in the forefoot area of the sole include grooves which extend into the ground contacting portions in a direction toward the upper and extend across a surface of the respective ground contacting portions.

3. Shoe according to claim 1, wherein the ground contacting portions are coated with at least one layer of breathable material.

4. Shoe according to claim 1, further comprising a medial portion located along a plantar arch and made of an elastically flexible plastic material.

5. Shoe according to claim 4, wherein said medial portion is made of an ethylene vinyl acetate material.

6. Shoe according to claim 1, wherein said ground contacting portions are attached to said upper by stitching.

7. Shoe according to claim 1, wherein said ground contacting portions are attached to said upper by gluing.

8. Shoe according to claim 1, wherein said layer defines a recess configured at a plantar arch of the foot.

9. Shoe according to claim 1, wherein said layer is made of a rubber material.

10. Shoe according to claim 1, wherein the channels formed in the isthmus area of the sole are oriented in a substantially transverse direction relative to the sole and wherein the channels formed in the forefoot area are oriented in a substantially longitudinal direction relative to the sole.

11. Shoe according to claim 1, wherein said upper comprises a fastener around the foot.

12. Sole for a shoe, comprising:

five separate front seats adapted to hold respective toes of a wearer;

a plurality of ground contacting portions disposed on a lower part of the sole and adapted to rest on the ground, the ground contacting portions arranged substantially contiguous to each other along a plantar surface, a plurality of separation channels delimited by the ground contacting portions and extending between adjacent ones of said ground contacting portions, the channels configured to ensure that said portions can freely move in space, one in respect to another in relation to movements made by a wearer's foot; and a plurality of surface bulges disposed on and protruding from at least some of the plurality of ground contacting portions, one surface bulge adjacent to another;

wherein said surface bulges have a substantially circular shape;

wherein said circular shaped surface bulges are disposed only on the ground contacting portions which are located in isthmus and heel areas of the sole;

wherein each ground contacting portion located in a forefoot area of the sole includes grooves which extend into the ground contacting portions in a direction toward the upper and extend across a surface of the respective ground contacting portions;

the sole further comprising:

three ground contacting phalangeal portions disposed on each of the five seats of the sole and configured to rest on the ground, wherein said ground contacting phalangeal portions are interspersed with separation channels; and a rubber layer defining a recess at the plantar arch, the rubber layer extending continuously an entire length of the sole from a heel area of the sole to a toe area of the sole and wherein the plurality of ground contacting portions are attached to the rubber layer.

13. Shoe according to claim 10, wherein a width of the channels in the forefoot area is greater than a width of the channels in the isthmus area.

14. Shoe according to claim 1, wherein the ground contacting portions located at the isthmus area are smaller than the ground contacting portions located at the forefoot and heel areas.

15. Shoe according to claim 1, wherein the separation channels located in the forefoot area have a width that is smaller than a width of the separation channels located in the isthmus area.

16. Shoe according to claim 1, further comprising ground contacting portions disposed at a location on the sole under a metatarsal head at a base of each toe of the foot of the wearer.

17. Shoe according to claim 1, wherein the ground contacting portions located in the forefoot area comprise grooves that extend transversely across an entire width of said ground contacting portions.

* * * * *